US007578016B1

(12) United States Patent
McCraw

(10) Patent No.: US 7,578,016 B1
(45) Date of Patent: Aug. 25, 2009

(54) ONE-SIDED INNERSPRING ASSEMBLY

(75) Inventor: Kevin N. McCraw, Micaville, NC (US)

(73) Assignee: Hickory Springs Manufacturing Company, Hickory, NC (US)

( * ) Notice: Subject to any disclaimer, the term of this patent is extended or adjusted under 35 U.S.C. 154(b) by 155 days.

(21) Appl. No.: 11/983,172

(22) Filed: Nov. 7, 2007

(51) Int. Cl.
*A47C 27/04* (2006.01)

(52) U.S. Cl. ..... 5/716; 5/727; 5/269; 5/271

(58) Field of Classification Search ..... 5/716, 5/717, 727, 655.7, 269, 271; 267/91, 93, 267/103, 108
See application file for complete search history.

(56) References Cited

U.S. PATENT DOCUMENTS

| | | | | |
|---|---|---|---|---|
| 237,557 | A | 2/1881 | Learnard | |
| 245,971 | A | 8/1881 | Nelson et al. | |
| 1,895,429 | A | 1/1933 | Foster | |
| 1,897,309 | A | 2/1933 | Karr | |
| 3,716,874 | A | 2/1973 | Thomas, Jr. | 5/260 |
| 4,160,544 | A | 7/1979 | Higgins | 267/166 |
| 4,609,186 | A | 9/1986 | Thoenen | 267/91 |
| 4,679,266 | A * | 7/1987 | Kraft | 5/716 |
| 5,575,460 | A | 11/1996 | Knöpfel | 267/91 |
| 5,584,083 | A * | 12/1996 | Ramsey et al. | 5/271 |
| 5,924,682 | A | 7/1999 | Bullard | 267/103 |
| 5,934,339 | A | 8/1999 | Ramsey | 140/3 |
| 6,318,416 | B1 | 11/2001 | Grueninger | 140/3 |
| 6,339,857 | B1 * | 1/2002 | Clayton | 5/716 |
| 6,375,169 | B1 | 4/2002 | McCraw et al. | 267/75 |
| 6,931,685 | B2 | 8/2005 | Kuchel et al. | 5/716 |
| 6,948,348 | B2 | 9/2005 | Wells et al. | 72/134 |
| 7,044,454 | B2 | 5/2006 | Colman et al. | 267/91 |
| 7,386,897 | B2 * | 6/2008 | Eigenmann et al. | 5/248 |
| 7,404,223 | B2 * | 7/2008 | Manuszak et al. | 5/716 |
| 2007/0169275 | A1 * | 7/2007 | Manuszak et al. | 5/716 |

* cited by examiner

*Primary Examiner*—Michael Trettel
(74) *Attorney, Agent, or Firm*—K&L Gates LLP

(57) ABSTRACT

A spring cushion assembly for a one-sided mattress includes a plurality of spring coils. Each spring coil has a length of spring wire formed at opposite upper and lower ends in respective upper and lower end turns and in an intervening coil extent therebetween. The spring coils are characterized in that the lower end turns of each coil is closed by a knot formed between the lower wire end and the coil extent. The spring coils are further characterized in that the upper end turn of a first selected number of the spring coils is open with the upper wire end unknotted to the coil extent and the upper end turn of a second selected number of the spring coils is closed by a knot formed between the upper wire end and the coil extent.

12 Claims, 12 Drawing Sheets

ONE-SIDED INNERSPRING ASSEMBLY

TECHNICAL FIELD

The present invention relates generally to innerspring assemblies formed of a plurality of spring coils and, more particularly, to such an innerspring assembly suitable for use in a one-sided mattress.

BACKGROUND

Innerspring assemblies of the aforementioned type are well known within the furniture industry for use in connection with mattresses as well as other forms of upholstered furniture. Characteristically, such innerspring assemblies comprise a plurality of resiliently compressible spring coils arranged in adjacent side-by-side disposition in a selected systematic array, most commonly in linear rows and columns, and connected together, e.g., by metal bands, clips, strings, helical wires, or the like, to form an integrated spring cushion assembly. Such innerspring assemblies used for mattresses also commonly include border rods, which may be continuous or discontinuous, forming a perimeter outwardly about and connected to the upper and lower end turns of the outermost spring coils.

The types, configurations and constructions of the spring coils utilized in such innerspring assemblies are quite diverse and may differ, for example, according to the type and size (gauge) of the wire from which the spring coils are made, the number of intervening coil turns between the opposite end turns (which may be a whole number of turns or may include a one-half coil turn), whether the spring coils are separate wire units or part of a common length of wire, and whether the upper and lower end turns of each spring coil are closed (the terminal wire ends of the spring coil are knotted to a medial point along the end coil) or open (the terminal wire ends are left free and unconnected). With respect to any given innerspring assembly, the selection among these various characteristics for the spring coils is made according to considerations of the desired spring characteristics for the cushion assembly, cost, structural stability and rigidity of the cushion assembly. In particular, the fact of being knotted or open at the upper and lower end turns of each spring coil can have an effect on the overall comfort and feel of the innerspring assembly when used in a mattress.

In the current mattress market, there has been increased demand for one-sided mattresses, which may be maintained in active use without requiring physical flipping of the mattress over the useful life of the mattress. Designs for known one-sided mattresses have focused on adopting changes to the mattress padding or the mattress cover, whereby the bottom surface of the mattress is lightly padded and the top surface includes comfortable padding as a sleep surface. However, in many regards, these variations to the surface characteristics of the mattress do not account for the full range of options and level of comfort expected by customers. Accordingly, there exists a need for a comfortable innerspring assembly that is capable of providing a soft and supportive sleeping surface suited for consistent use as a one-sided mattress.

Furthermore, existing designs for one-sided mattresses have not been able to provide for varying ranges of comfort based on variations in the spring support within the spring cushion assembly across the sleeping surface of the mattress. Such a feature can be expected to have even greater significance to customers who select a mattress based on a preference for differing levels of firmness in certain areas of the mattress, such as might be the case for customers who prefer greater support in the head area of the mattress. Further, many health conditions necessitate that a customer select a mattress that provides differing levels of firmness, such as might be the case for customers with lower back pain who need greater support in the center of the mattress. As a result, there exists a need in this expanding industry to provide an innerspring assembly for a one-sided mattress that meets customer expectations for varying comfort zones.

SUMMARY

In accordance with the afore-mentioned goals, the present invention is a one-sided innerspring assembly that includes a plurality of spring coils each comprised of a length of spring wire formed at opposite upper and lower wire ends in respective upper and lower end turns and in an intervening coil extent therebetween. The spring coils are arranged side by side one another in parallel linear spring coil rows and parallel linear spring coil columns perpendicular to the spring coil rows, with the upper end turns of the spring coils essentially coplanar with each other and with the lower end turns essentially coplanar with each other. The lower end turn of each spring coil is closed by a knot formed between the lower wire end and the coil extent. The upper end turn of each spring coil of a first selected number of the spring coils is open with the upper wire end unknotted to the coil extent, and the upper end turn of each spring coil of a second selected number of the spring coils is closed by a knot formed between the upper wire end and the coil extent. A plurality of connector wires integrates the upper end turns and lower end turns of the spring coils, respectively, for forming a stable lower base of the spring assembly.

Various arrangements of the spring coils are contemplated. The spring coils that are knotted at the upper end turn may be selectively arranged with respect to the spring coils that are open at the upper end turn to form a plurality of zones with differing levels of relative firmness. In one arrangement, a first zone comprised of spring coils being knotted at the upper end turn extends along the outer perimeter of the spring assembly and surrounds a second zone comprised of spring coils being open at the upper end turn. In another arrangement, first and second zones each comprised of spring coils being open at the upper end turn extend along opposite sides of the spring assembly on either side of a third zone of spring coils being knotted at the upper end turn. In still another arrangement, first, second and third zones each comprised of spring coils being open at the upper end turn are arranged as spaced-apart rows with fourth and fifth zones each comprised of spring coils being knotted at the upper end turn interspersed between the first, second and third zones.

In a preferred embodiment of the present invention, in at least a portion of the spring coils having the upper end turn being open with the upper wire end unknotted to the coil extent, the portion of the length of spring wire forming the upper end turn includes at least one sinuous twist arranged therein.

The present invention further provides for a one-sided mattress comprised of an innerspring assembly as set forth herein.

Further areas of applicability of the present invention will become apparent from the detailed description provided hereinafter. It should be understood that the detailed description and specific examples, while indicating the preferred embodiments of the invention, are intended for purposes of illustration only and are not intended to limit the scope of the invention.

BRIEF DESCRIPTION OF THE DRAWINGS

For a more complete understanding of this invention reference should now be had to the preferred embodiments illustrated in greater detail in the accompanying drawings, and described below. In the drawings, which are not necessarily to scale.

DETAILED DESCRIPTION

Figure 1A:
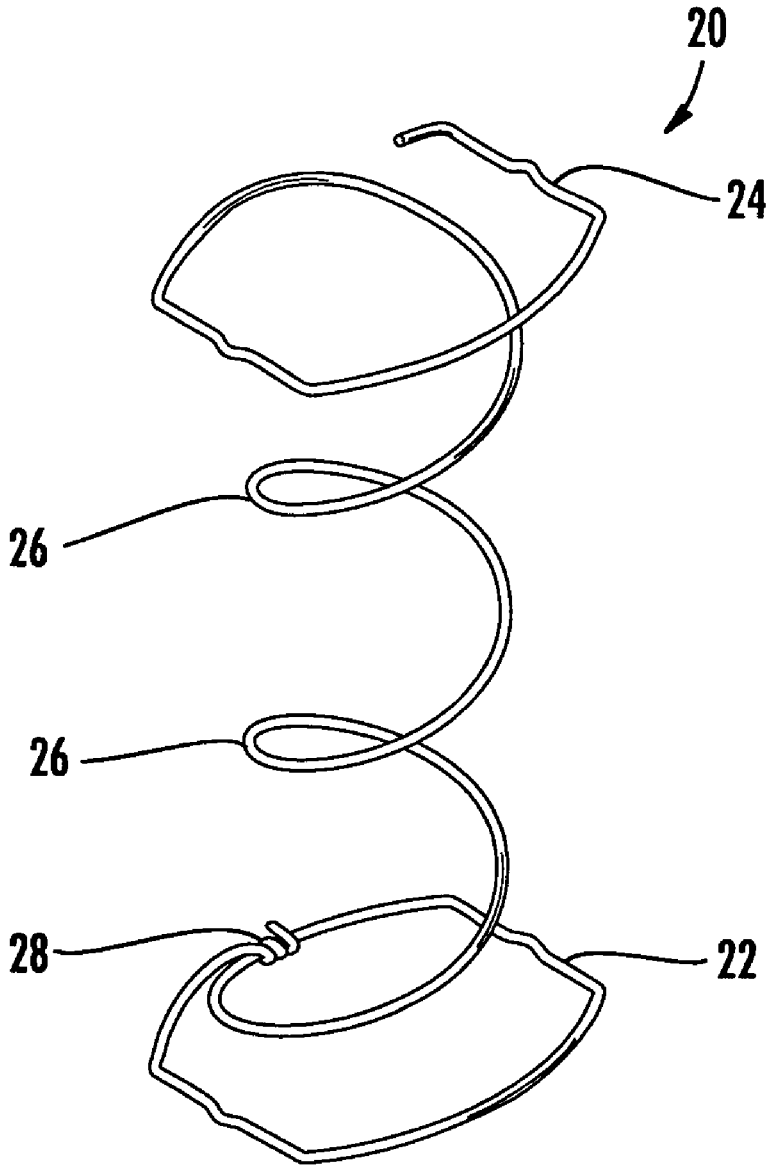
FIG. 1A is a perspective view of a single spring coil with the lower end turn thereof being knotted and the upper end turn thereof being unknotted.

The present invention will now be described fully hereinafter with reference to the accompanying drawings, in which preferred embodiments of the invention are shown. This invention may, however, be embodied in many different forms and should not be construed as limited to the preferred embodiments set forth herein. Rather, these preferred embodiments are provided so that this disclosure will be thorough and complete, and will fully convey the scope of the invention to those skilled in the art. It will be understood that all alternatives, modifications, and equivalents are intended to be included within the spirit and scope of the invention as defined by the appended claims. Like reference numerals represent like parts and features throughout the several views.

Figure 1B:
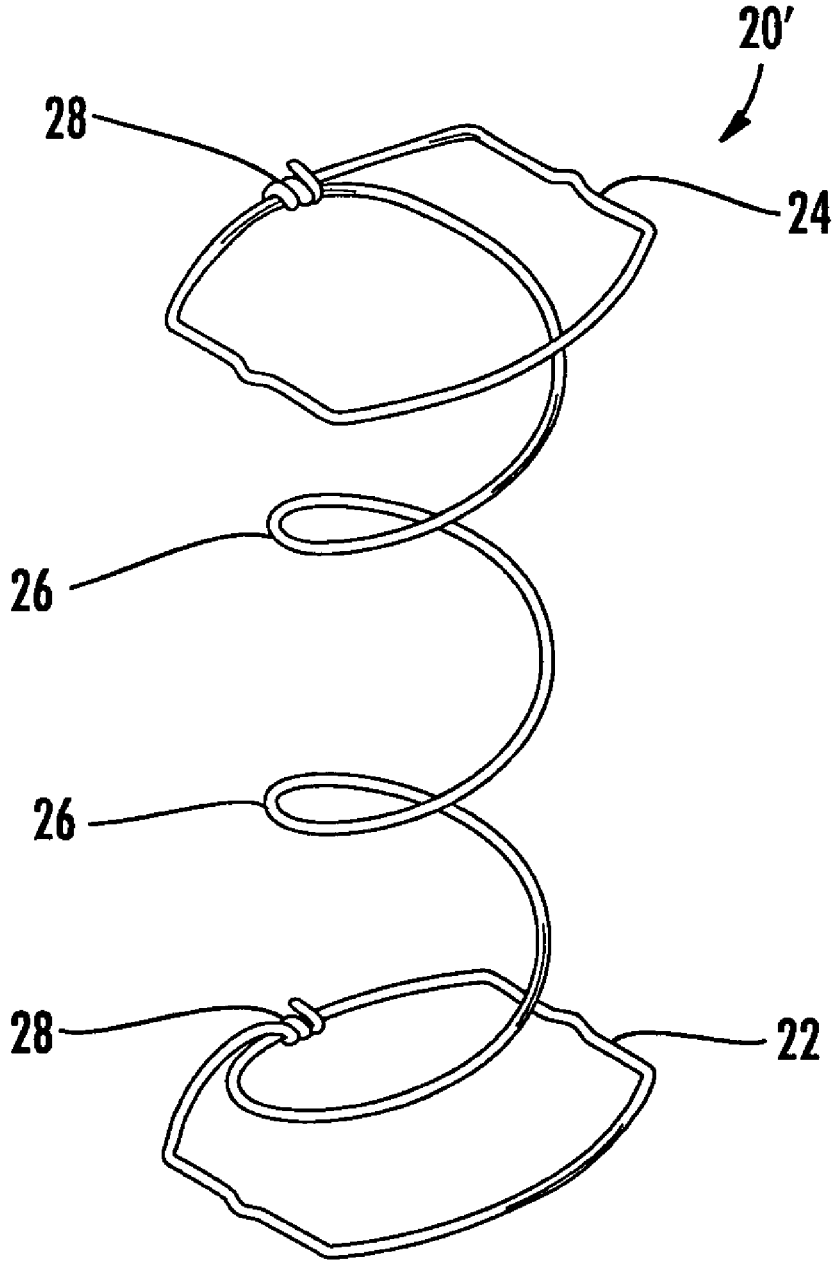
FIG. 1B is a perspective view of a single spring coil with the lower and upper end turns thereof being knotted.
Figure 2:
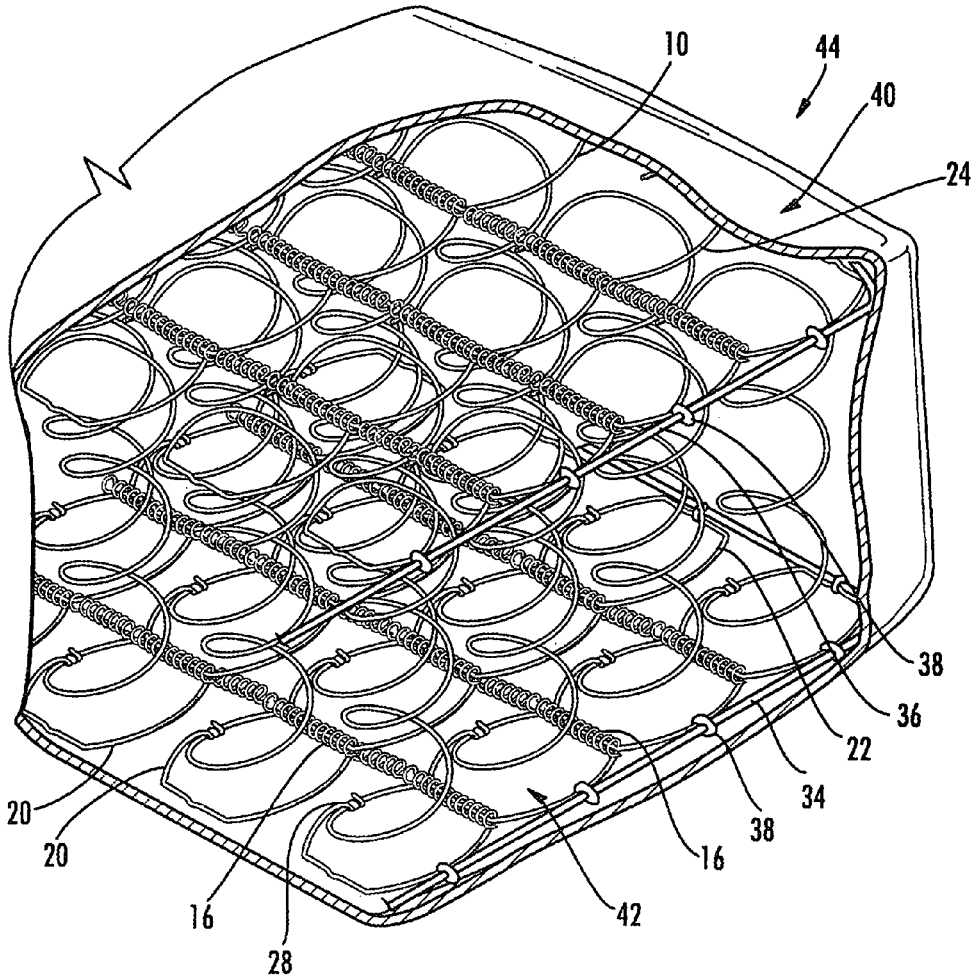
FIG. 2 is a partial cutaway perspective view of an innerspring assembly comprised of a plurality of spring coils in a one-sided mattress.
Figure 3:
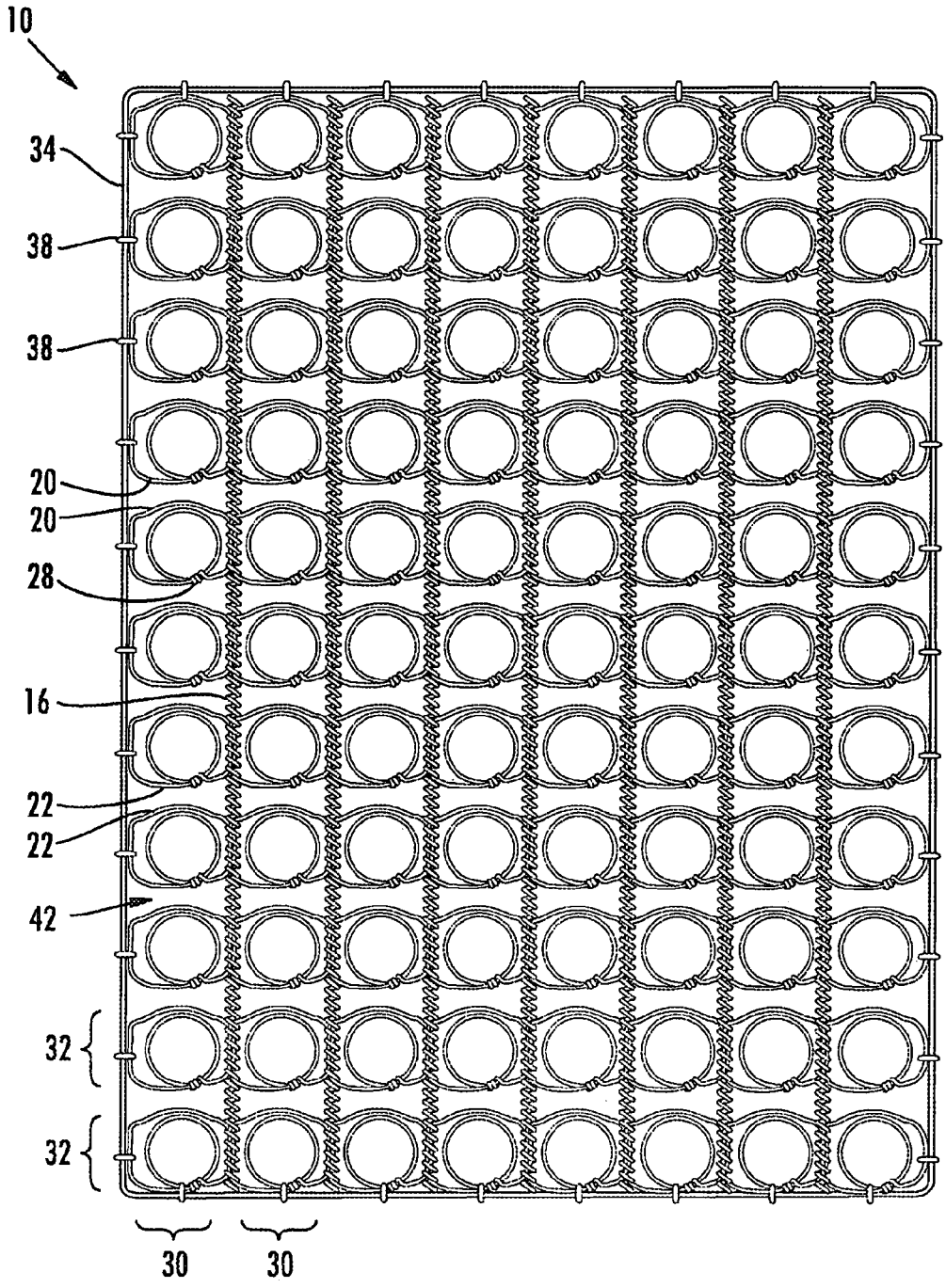
FIG. 3 is a bottom plan view of one embodiment of an innerspring assembly comprised of a plurality of spring coils each with the same orientation.
Figure 8:
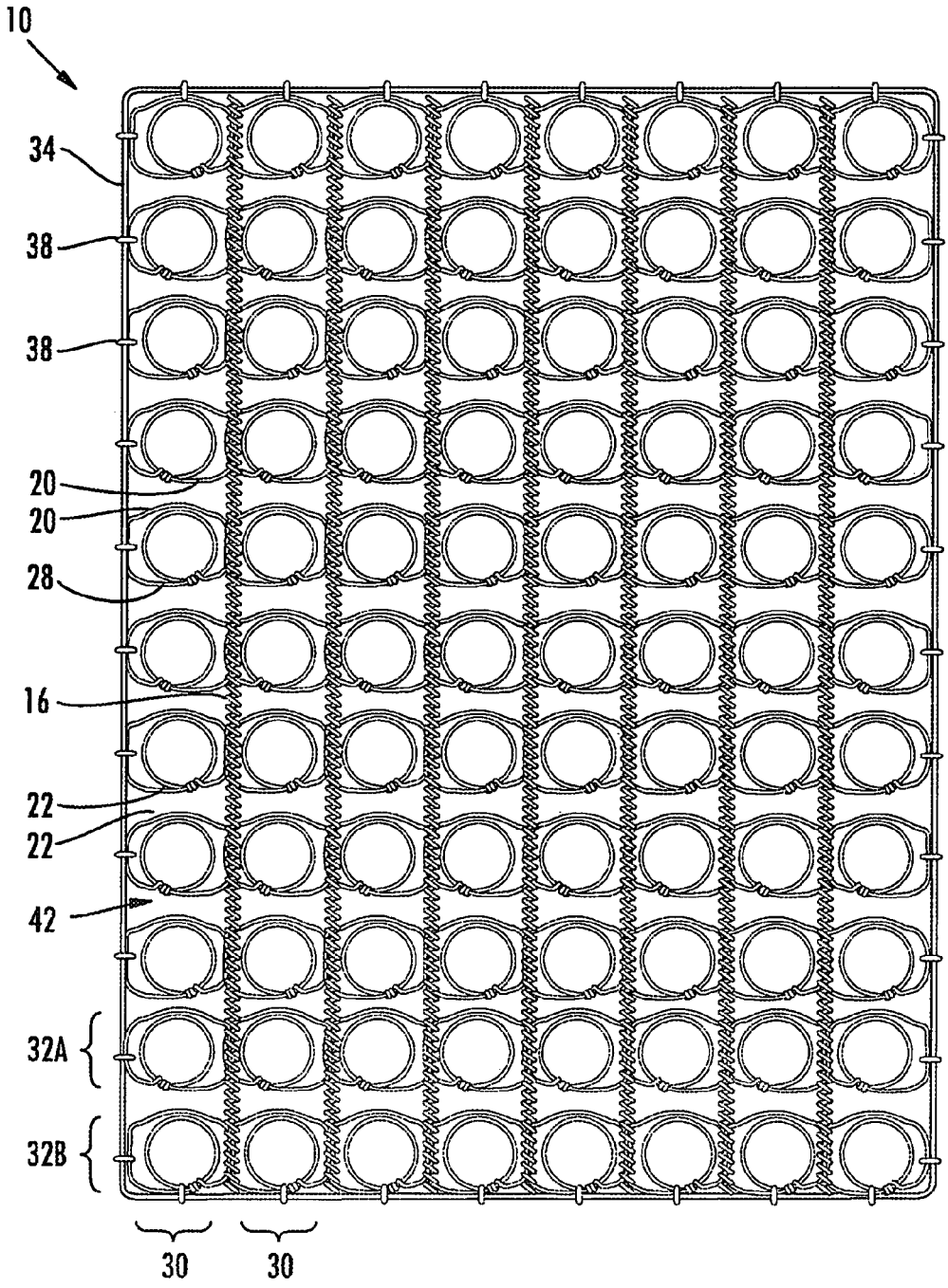
FIG. 8 is a bottom plan view of another embodiment of an innerspring assembly comprised of a plurality of spring coils arranged in rows with adjacent rows having spring coils of alternating orientation.

Referring now to the accompanying drawings and initially to FIGS. 1A, 1B and 2, the innerspring assembly 10 for a one-sided mattress in accordance with the present invention comprises a plurality of spring coils 20, 20' of the type depicted in FIGS. 1A and 1B, each with lower and upper end turns 22, 24, and having one or more central turns 26 extending between the respective end turns 22, 24 of each spring coil 20, 20'. The central turns 26 provide the spring coils 20, 20' with the spring-like effect commonly associated with innerspring assemblies for mattresses. As depicted in FIGS. 2, 3 and 8, the spring coils 20, 20' are arranged with their respective lower and upper end turns 22, 24 in generally co-planar relationship with one another. The spring coils 20, 20' are arranged in adjacent columns 30 and rows 32 such that spring coils 20, 20' of adjacent columns 30 are interconnected together with one another between the spirals of elongate helical connector wires 16, each extending the extent of the innerspring assembly 10.

The innerspring assembly 10 may include lower and upper rectangular border rods 34, 36 that extend around the perimeter of the plurality of spring coils 20, 20'. Specifically, the border rods 34, 36 extend around the perimeter of the innerspring assembly 10 adjacent the lower and upper end turns 22, 24, respectively, of the outermost columns 30 and rows 32 of the innerspring assembly 10. The border rods 34, 36 are connected to the lower and upper end turns 22, 24, respectively, by metal bands or clasps 38. The border rods 34, 36 typically may be of a much higher gauge than the wires of the spring coils 20, 20' and the helical connector wires 16. In place of the border wires 34, 36, the innerspring assembly 10 may include helical connector wires that extend along the top and bottom edges at each end of the innerspring assembly 10. Such helical connector wires at the top and bottom edges may have a similar construction to the elongate helical connector wires 16 that interconnect adjacent columns 30 of spring coils 20, 20'.

As depicted in FIG. 1A, the upper end turn 24 of at least a selected number of individual spring coils 20 is open with the upper wire end unknotted to the coil extent at the upper end turn 24. The upper end turn 24 is the coil end of the spring coil 20 that is nearest to the sleep surface 40 of the innerspring assembly 10. The open, unknotted end structure facilitates relative softness on the sleep surface 40 by providing more active working wire to the coil, wherein the helical structure of the wire coil extends through to the coil extent at the upper end turn 24 without interruption. Additionally, the relative softness and flexibility of spring coils 20 with an open, unknotted upper end turn 24 is enhanced by the ability for such coils to function with greater independence from other spring coils 20 in the innerspring assembly 10. As depicted in FIG. 1B, and as will be explained in greater detail below, the upper end turn 24 of a second selected number of the spring coils 20' is closed by a knot 28 formed between the upper wire end and the coil extent.

As depicted in FIGS. 1A and 1B, the lower end turn 22 of each individual spring coil 20 is closed by a knot 28 formed between the lower wire end and the coil extent at the lower end turn 22. The lower end turn 22 is the coil end of the spring coil 20 that is nearest the lower surface 42, which is opposite of the sleep surface 40 of the innerspring assembly 10. Knotting of the lower end turn 22 of each spring coil 20 restricts the ability of the spring coils 20 to move independently of one another, thereby creating a deck-like sheet at the lower surface 42 opposite the sleep surface 40. Additionally, the knot 28 at the lower end turn 22 of each spring coil 20 reduces the spring-like effect at the lower end turn 22 and thereby enhances the stability of the spring assembly 10 at the lower surface 42.

Combining an open, unknotted upper end turn 24 with a knotted lower end turn 22 on a single spring coil 20, as shown in FIG. 1A, provides an innerspring assembly 10 with a softer, more independent sleeping surface 40 and a deck-like, firm and more dependent lower surface 42 opposite of the sleeping surface 40. FIG. 2 provides a perspective view wherein each of the sleeping surface 40 and the lower surface 42 are visible within the cutaway portion of a one-sided mattress 44 in accordance with the present invention. When utilized in a one-sided mattress 44, the lower surface 42 of the innerspring assembly 10 provides the firm, deck-like support necessary to support the mattress and weight applied thereto, while the soft, more independent sleeping surface 40 provides greater comfort to the one-sided mattress 44. The characteristics inherent in each of these surfaces 40, 42, in combination with known features such as enhanced padding on the sleep surface, augment the performance of the one-sided mattress 44 so as to maintain a particular level of comfort over the life of the mattress.

Figure 4:
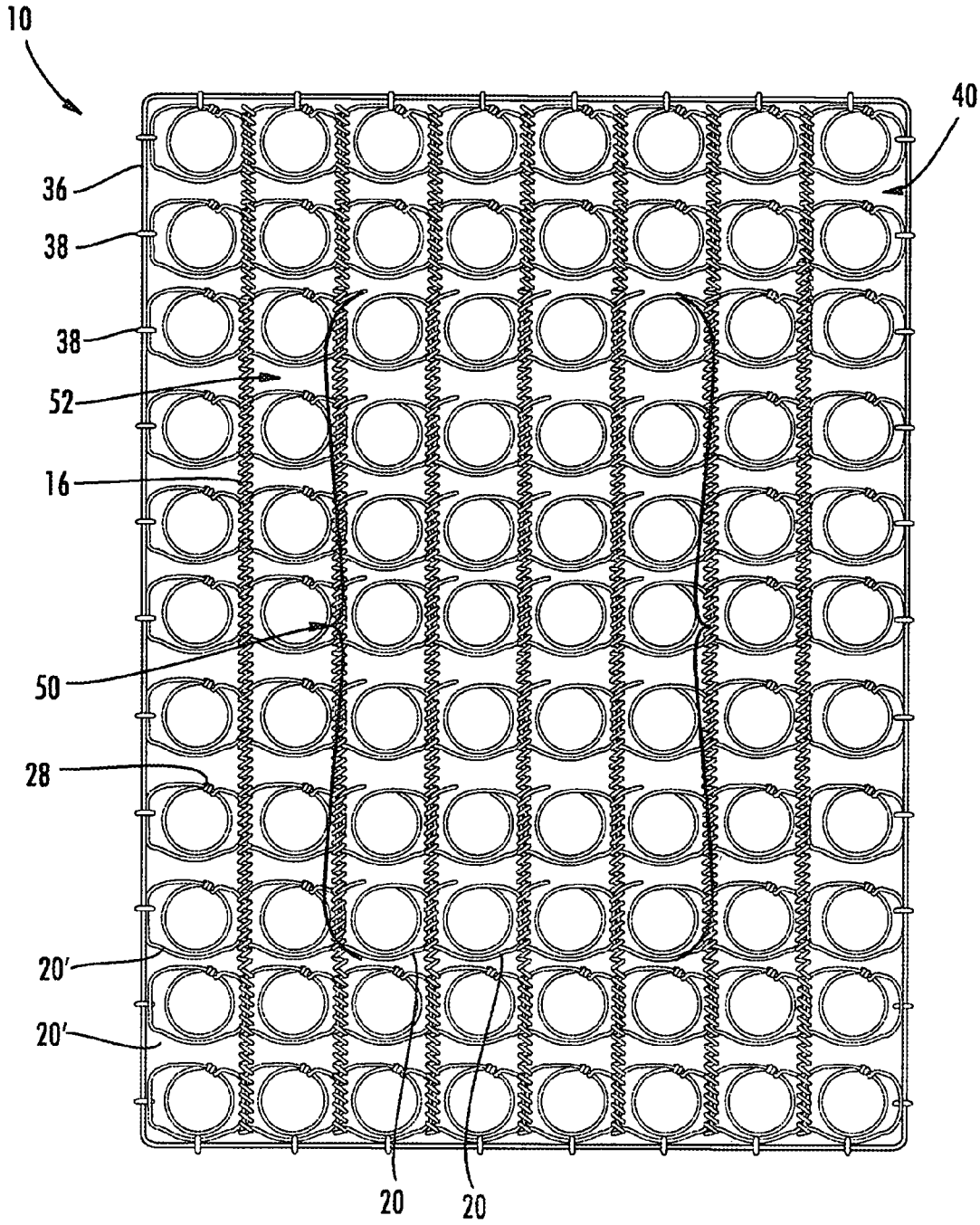
FIGS. 4-6 are varying top plan views of innerspring assemblies in accordance with the embodiment of FIG. 3, each assembly having the spring coils arranged so as to create different zones of relative firmness.
Figure 5:
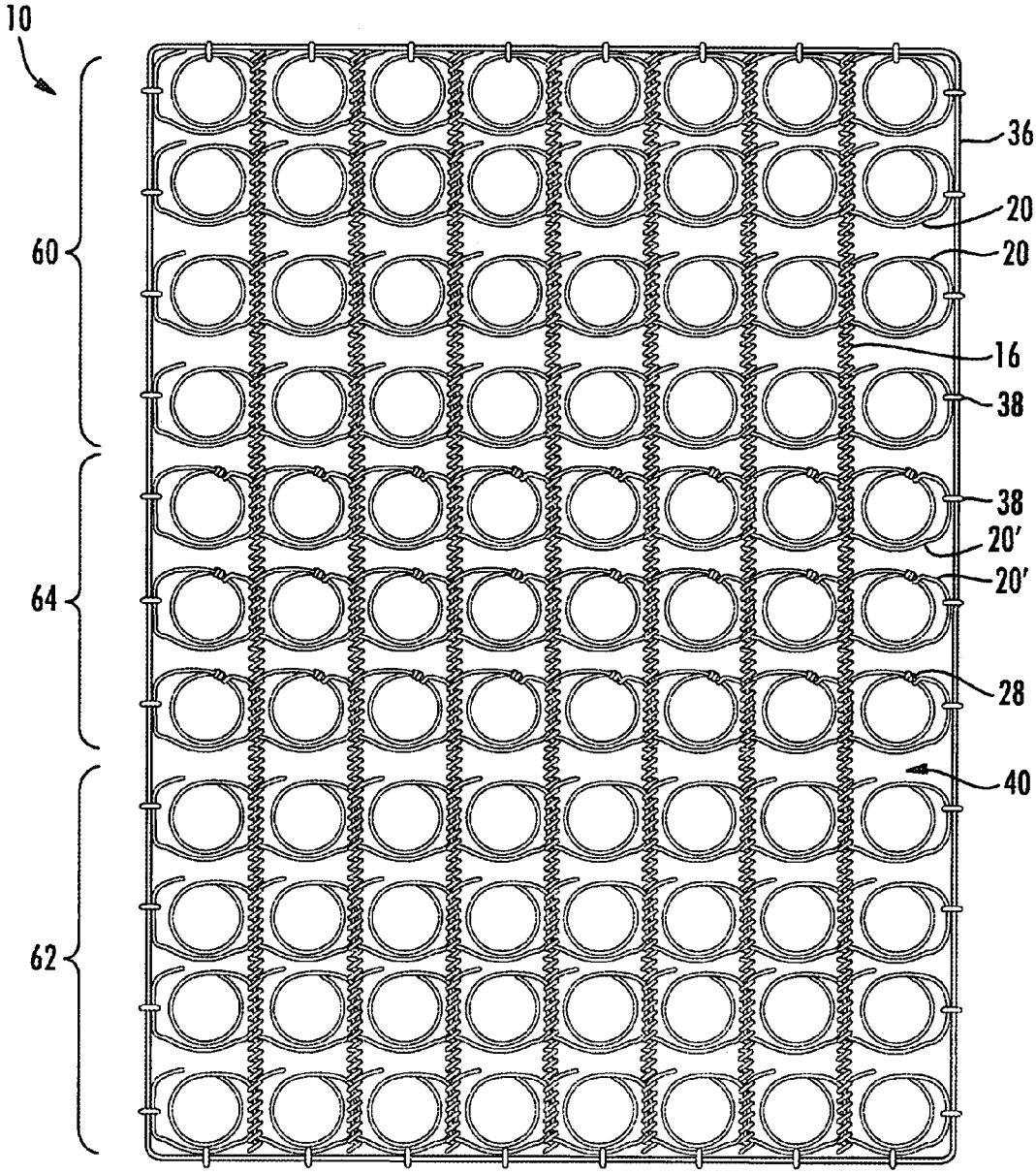
Figure 6:
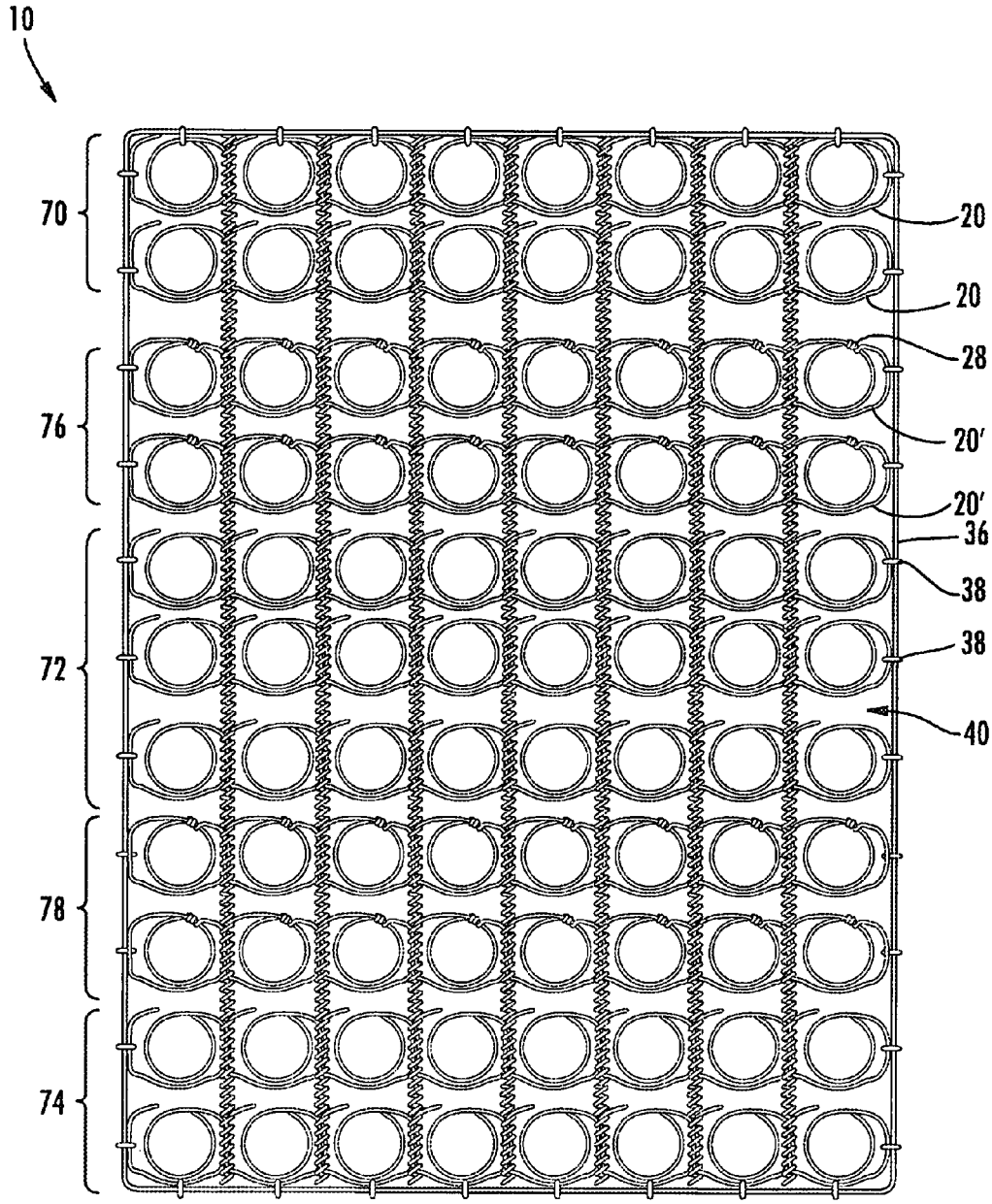

As depicted in FIGS. 3-6, the lower end turn 22 of each spring coil 20, 20' is closed by a knot 28 formed between the lower wire end and the coil extent. FIG. 3 sets forth a view of the lower surface 42 of an innerspring assembly 10 in accordance with the present invention, which illustrates the knot 28 formed at the lower end turn 22 of each spring coil 20, 20'. With reference to FIGS. 4-6, which set forth views of the sleeping surface 40 of various embodiments of the present invention, at least some of the spring coils 20' are closed with a knot 28 at the upper end turn 24 of the respective spring coil 20'. In this regard, spring coils 20 that are open with the upper wire end unknotted to the coil extent at the upper end turn 24 and spring coils 20' that are closed by a knot 28 formed between the upper wire end and the coil extent at the upper end turn 24 are arranged with respect to one another so as to form a plurality of zones in the sleeping surface 40 of the innerspring assembly 10 having differing levels of relative firmness. Zones comprising spring coils 20 that are open with the upper wire end unknotted to the coil extent at the upper end turn 24 are softer and more independent while zones comprising spring coils 20' that are closed by a knot 28 formed between the upper wire end and the coil extent at the upper end turn 24 are more deck-like and firm. In order to maintain the firm, deck-like aspect of the lower surface 42, all spring coils 20, 20' are closed by a knot 28 formed between the lower wire end and the coil extent at the lower end turn 22.

In one embodiment, the sleep surface 40 of which is depicted in FIG. 4, the spring coils 20, 20' are arranged with respect to one another to form a first zone 50 and a second zone 52. The first zone 50 is comprised of spring coils 20 that are open with the upper wire end unknotted to the coil extent at the upper end turn 24 that extends along the outer perimeter of the innerspring assembly 10. The second zone 52 is comprised of spring coils 20' that are closed by a knot 28 formed between the upper wire end and the coil extent at the upper end turn 24 and is situated such that the second zone 52 fully surrounds the first zone 50. In this regard, the first zone 50 provides a softer and more independent interior to the sleep surface 40 while the second zone 52 provides a more firm, deck-like perimeter support to the sleep surface 40. An innerspring assembly 10 in accordance with this embodiment of the present invention, as depicted in FIG. 4, may be particularly well-suited to those who prefer or require softer back and torso support with firm head support in a one-sided mattress. Additionally, as the perimeter of the innerspring assembly 10 provides more firm support, this embodiment may be preferable to those who tend to sit on the edge of a one-sided mattress.

In another embodiment, the sleep surface 40 of which is depicted in FIG. 5, the spring coils 20, 20' are arranged with respect to one another to form first and second zones 60, 62 each comprised of spring coils 20 that are open with the upper wire end unknotted to the coil extent at the upper end turn 24 and a third zone 64 comprised of spring coils 20' that are closed by a knot 28 formed between the upper wire end and the coil extent at the upper end turn 24. The first and second zones 60, 62 are arranged to extend along opposite sides of the innerspring assembly 10 on either side of the third zone 64. Therefore, the first and second zones 60, 62 provide a softer and more independent head and foot area to the sleep surface 40 while the third zone 64 provides a more firm, deck-like central support to the sleep surface 40. An innerspring assembly 10 in accordance with this embodiment of the present invention, as depicted in FIG. 5, is well-suited to those who may prefer or require more deck-like support in the back area with softer zones at the head and foot areas of the one-sided mattress.

In still another embodiment, the sleep surface 40 of which is depicted in FIG. 6, the spring coils 20, 20' are arranged with respect to one another to form first, second and third zones 70, 72, 74 each comprised of spring coils 20 that are open with the upper wire end unknotted to the coil extent at the upper end turn 24 and fourth and fifth zones 76, 78 comprised of spring coils 20' that are closed by a knot 28 formed between the upper wire end and the coil extent at the upper end turn 24. As depicted in FIG. 6, each of the zones 70, 72, 74, 76 78 is arranged as a spaced-apart row, with the fourth and fifth zones 76, 78 being interspersed between the first, second and third zones 70, 72, 74, with the first and third zones 70, 74 extending across the head and foot areas of the sleep surface 40, respectively, and the second zone 72 extending across the central area of the sleep surface 40. Accordingly, the head, foot and central areas of the sleep surface 40 provide a softer and more independent feel while areas extending along either side of the central area (represented by the fourth and fifth zones 76, 78) provide a more firm, deck-like central support to the sleep surface 40.

Other possible arrangements of spring coils 20, 20' beyond those specifically set forth herein are possible and are also within the scope of the present invention. Zones in the sleep surface 40 having differing level of relative firmness are often the subject of personal preference, wherein a particular area of a one-sided mattress may be preferred to have a softer more independent feel or a more firm, deck-like feel.

Figure 7:
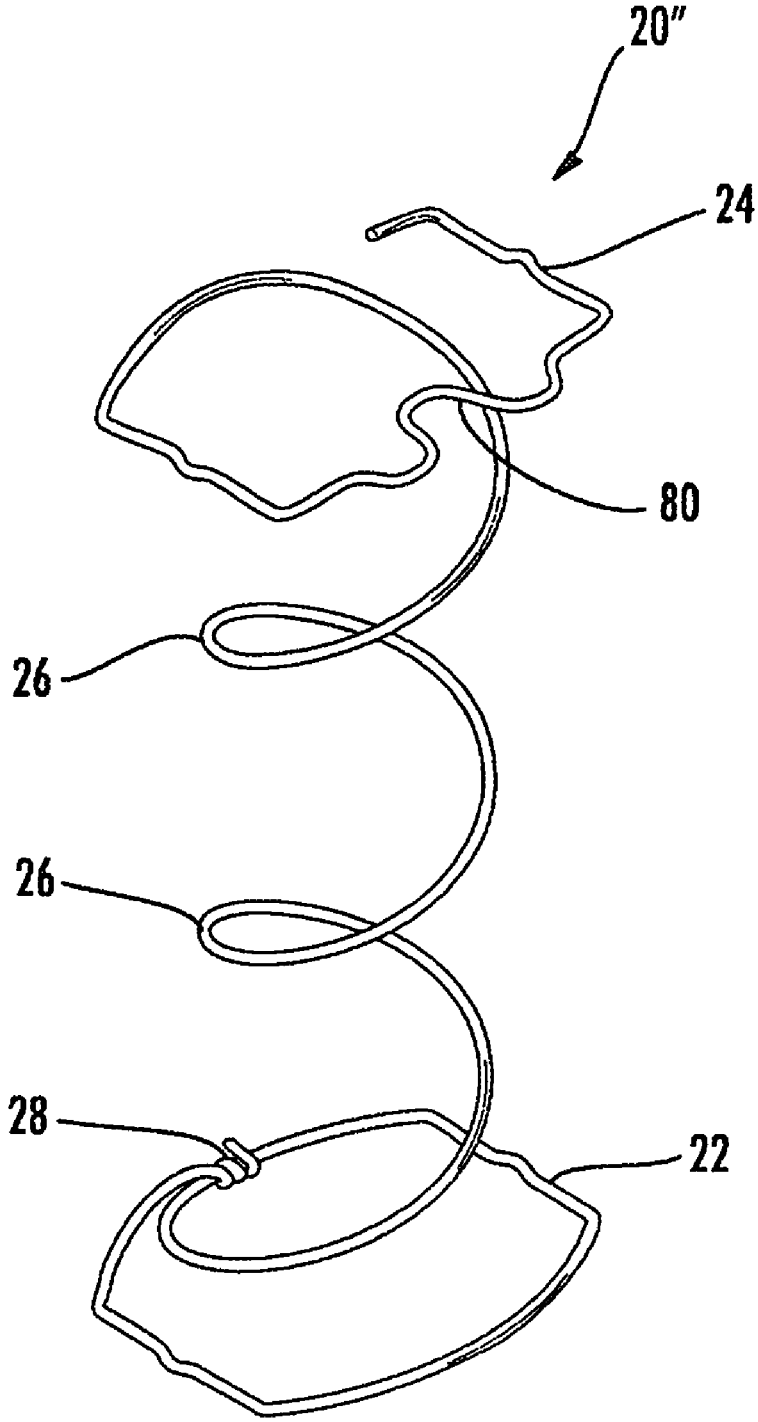
FIG. 7 is a perspective view of a single spring coil with the lower end turn thereof being knotted, the upper end turn thereof being unknotted and having a sinuous twist arranged in the upper end turn.

With reference now to FIG. 7, an alternate spring coil 20" is depicted. The spring coil 20" includes at least one sinuous twist 80 arranged in the coil extent at the upper end turn 24 of the spring coil 20". The at least one sinuous twist 80 at the upper end turn 24 allows the portion of the spring coil 20" that forms the upper end turn 24 to flex laterally, which enhances the independent relationship among spring coils and thereby assists in providing a more flexible, soft feel to the sleep surface 40 of the innerspring assembly 10. The sinuous twist 80 may be a full twist in the coil extent at the upper end turn 24, as shown in FIG. 7, or may be a slight offset in the coil extent at one side of the upper end turn 24. Other deformations in the coil extent at the upper end turn 24 may be implemented to accomplish a similar effect. For instance, similar deformations may include, but are not necessarily limited to, a curved notch in the coil extent or a small wire loop in the coil extent. In each instance, whether a sinuous twist as depicted in FIG. 7 or a similar deformation, the enhanced flexibility and independence in the spring coil 20" arises from the ability of the spring coil 20" to flex laterally in a manner that is relatively independent of other spring coils in the innerspring assembly. It is also possible that multiple sinuous twists 80 may be present within a single spring coil 20".

Spring coils 20" in accordance with FIG. 7 may comprise at least a portion of the selected number of individual spring coils that are open with the upper wire end unknotted to the coil extent at the upper end turn 24. It is also within the scope of the present invention for all of the selected number of spring coils that are open with the upper wire end unknotted to the coil extent at the upper end turn 24 to be spring coils 20" having at least one sinuous twist 80 at the upper end turn 24 in accordance with FIG. 7.

In accordance with other features of the present invention, the handedness of the spring coils 20, 20', 20" may be left or right. Handedness of the spring coils 20, 20', 20" refers to the orientation of the spring coil and the direction of the central turns 26 extending between the lower and upper end turns 22, 24. In general, use of both left-handed and right-handed spring coils in various arrangements within an innerspring assembly 10 provides some level of overall lateral stability to the innerspring assembly 10, as oppositely-handed spring coils 20, 20', 20" tend to counteract one another. Possible arrangements include, for instance, arranging spring coils 20, 20', 20" of like handedness in columns 30 or rows 32 that are interspersed with other rows or columns comprised of spring coils of alternating handedness. In this regard, adjacent columns 30 or rows 32 tend to counteract one another by the individual spring coils 20, 20', 20" inclining and twisting in opposite directions.

Figure 9:
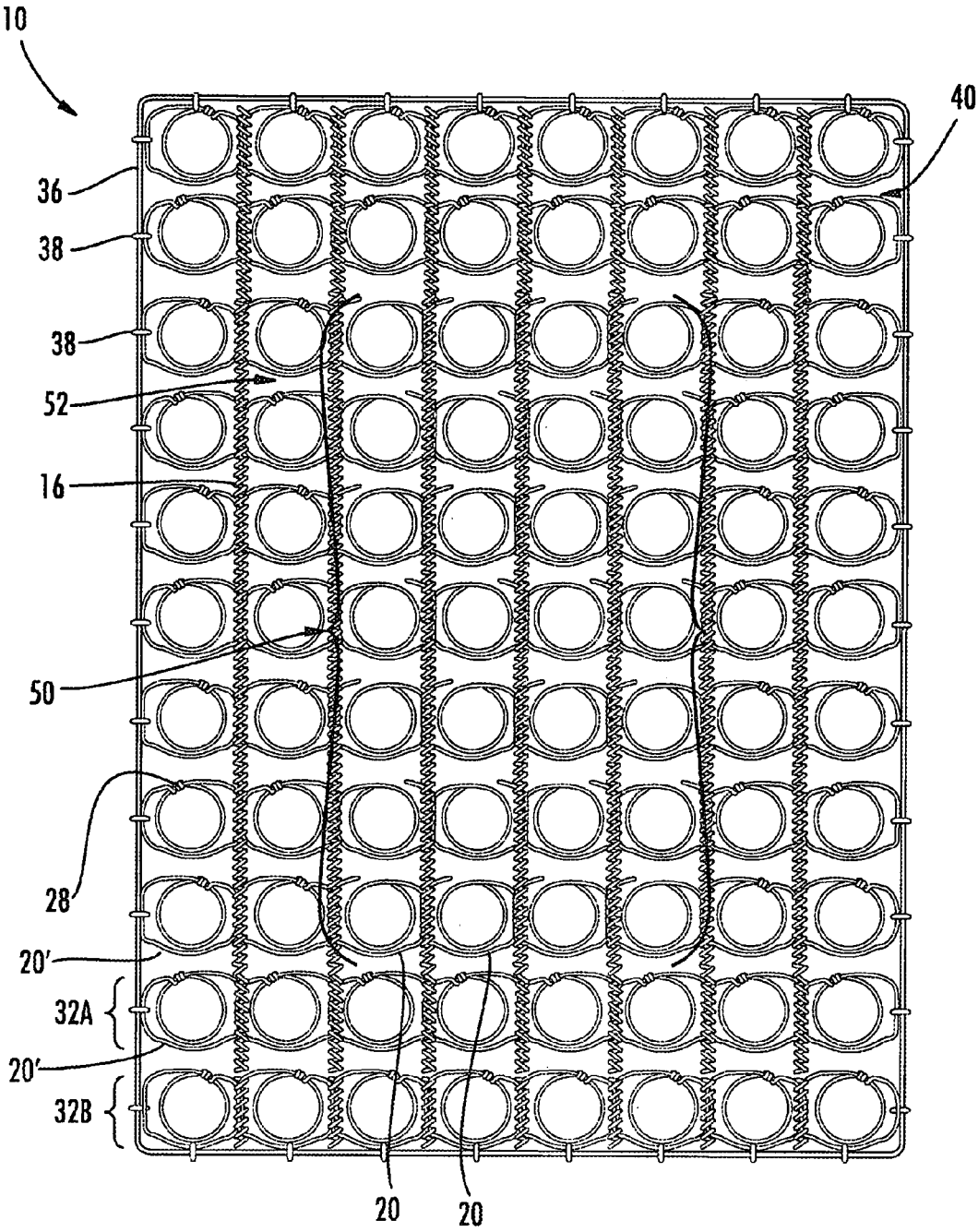
FIGS. 9-11 are varying top plan views of innerspring assemblies in accordance with the embodiment of FIG. 8, each assembly having the spring coils arranged so as to create different zones of relative firmness.
Figure 10:
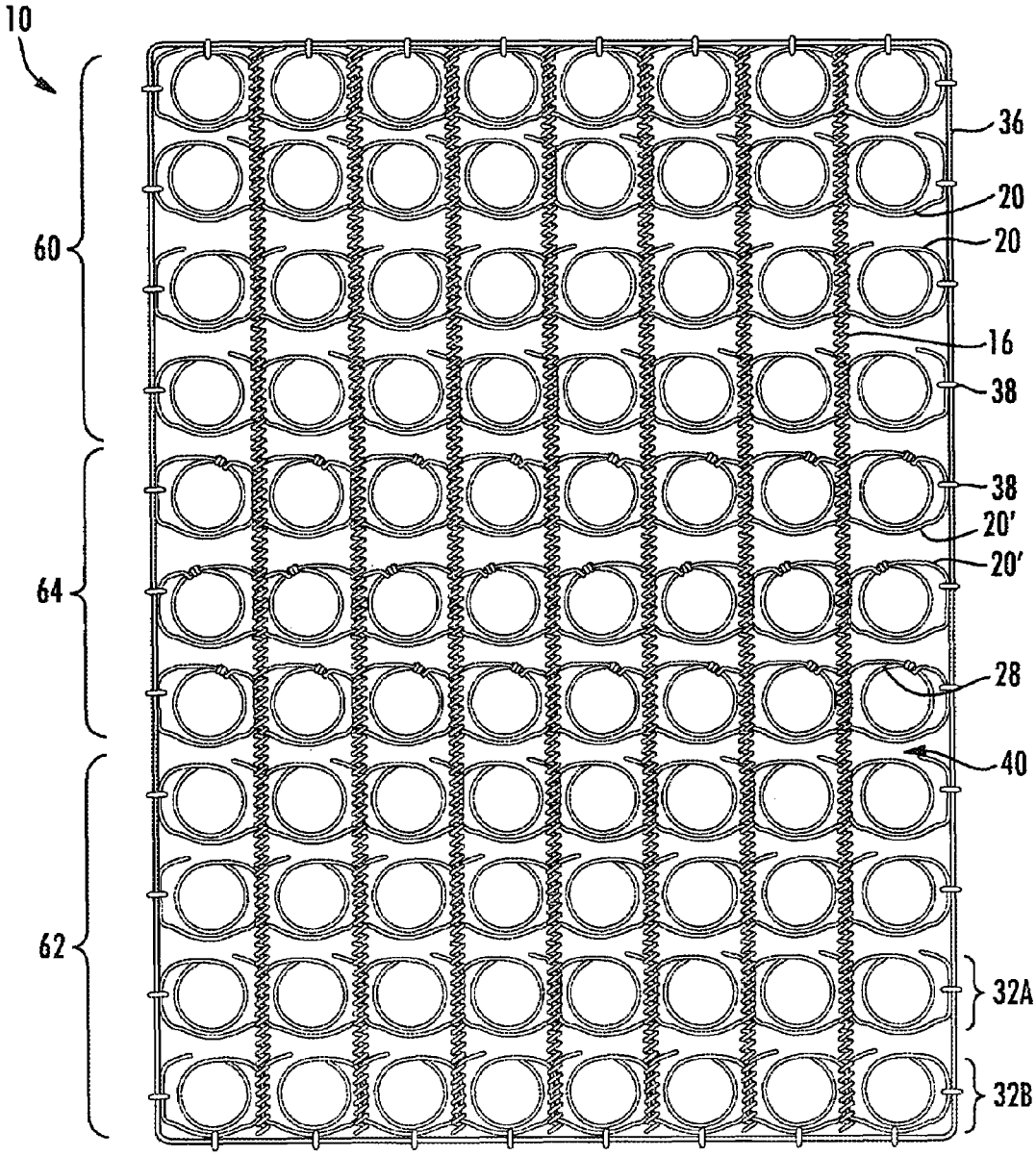
Figure 11:
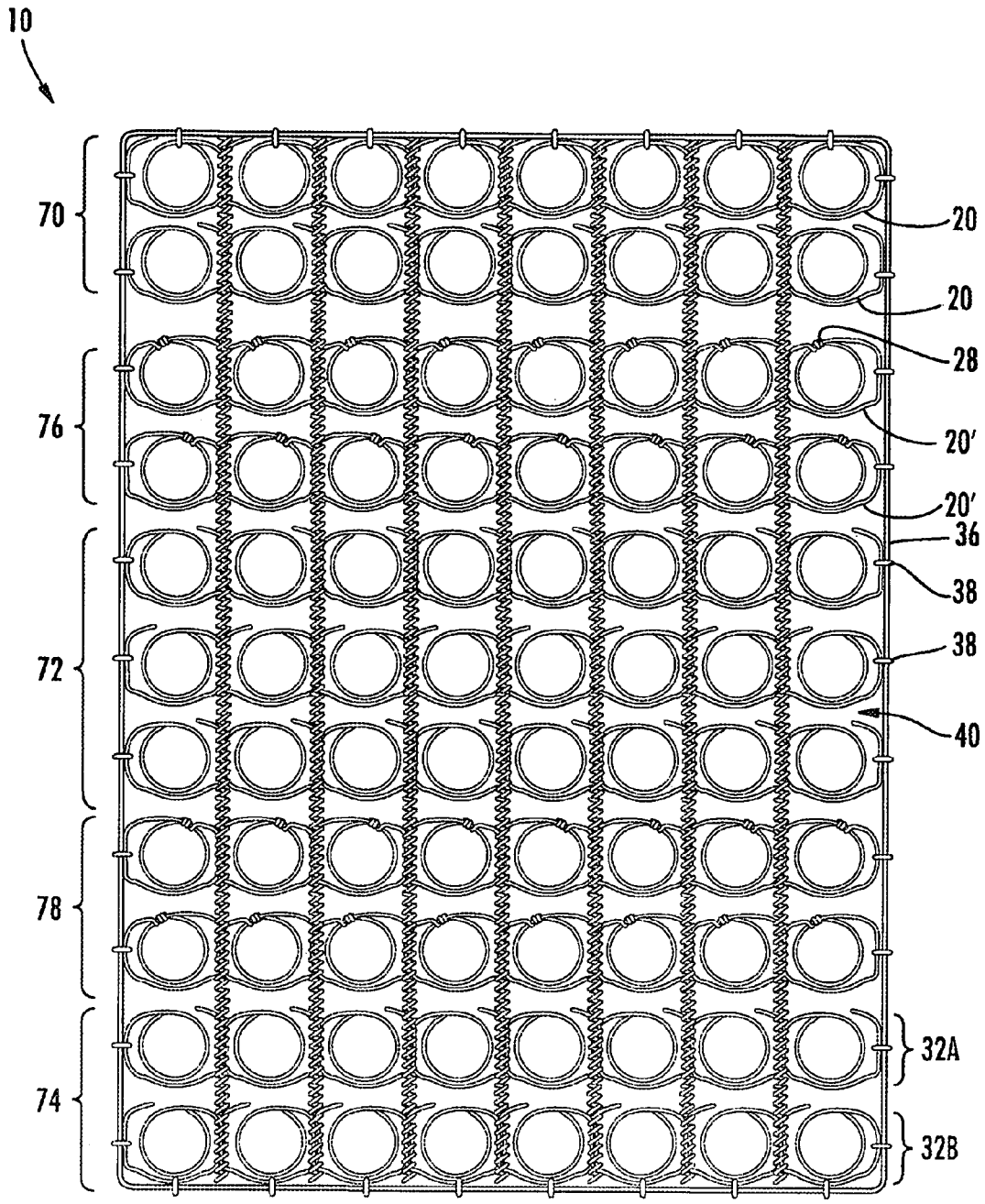

FIGS. 8-11 set forth various embodiments of the present invention, where adjacent rows 32A, 32B are comprised of spring coils 20, 20' of alternating handedness. FIG. 8 sets forth a view of the lower surface 42 of an innerspring assembly 10 in accordance with the present invention, which illustrates the knot 28 formed at the lower end turn 22 of each spring coil 20, 20'. FIGS. 9-11 set forth views of the sleeping surface 40 of various embodiments of the present invention, where, in each embodiment, at least some of the spring coils 20' are closed with a knot 28 at the upper end turn 24 of the respective spring coil 20'.

In FIG. 9, the spring coils 20, 20' are arranged with respect to one another to form a first zone 50 and a second zone 52. The first zone 50 is comprised of spring coils 20 that are open with the upper wire end unknotted to the coil extent at the upper end turn 24 that extends along the outer perimeter of the innerspring assembly 10. The second zone 52 is comprised of spring coils 20' that are closed by a knot 28 formed between the upper wire end and the coil extent at the upper end turn 24 and is situated such that the second zone 52 fully surrounds the first zone 50. In this regard, the first zone 50 provides a softer and more independent interior to the sleep surface 40 while the second zone 52 provides a more firm, deck-like perimeter support to the sleep surface 40. An innerspring assembly 10 in accordance with this embodiment of the present invention, as depicted in FIG. 4, may be particularly well-suited to those who prefer or require softer back and torso support with firm head support in a one-sided mattress. Additionally, as the perimeter of the innerspring assembly 10 provides more firm support, this embodiment may be preferable to those who tend to sit on the edge of a one-sided mattress.

In FIG. 10, the spring coils 20, 20' are arranged with respect to one another to form first and second zones 60, 62 each comprised of spring coils 20 that are open with the upper wire end unknotted to the coil extent at the upper end turn 24 and a third zone 64 comprised of spring coils 20' that are closed by a knot 28 formed between the upper wire end and the coil extent at the upper end turn 24. The first and second zones 60, 62 are arranged to extend along opposite sides of the innerspring assembly 10 on either side of the third zone 64. Therefore, the first and second zones 60, 62 provide a softer and more independent head and foot area to the sleep surface 40 while the third zone 64 provides a more firm, deck-like central support to the sleep surface 40. An innerspring assembly 10 in accordance with this embodiment of the present invention, as depicted in FIG. 5, is well-suited to those who may prefer or require more deck-like support in the back area with softer zones at the head and foot areas of the one-sided mattress.

In FIG. 11, the spring coils 20, 20' are arranged with respect to one another to form first, second and third zones 70, 72, 74 each comprised of spring coils 20 that are open with the upper wire end unknotted to the coil extent at the upper end turn 24 and fourth and fifth zones 76, 78 comprised of spring coils 20' that are closed by a knot 28 formed between the upper wire end and the coil extent at the upper end turn 24. As depicted in FIG. 6, each of the zones 70, 72, 74, 76 78 is arranged as a spaced-apart row, with the fourth and fifth zones 76, 78 being interspersed between the first, second and third zones 70, 72, 74, with the first and third zones 70, 74 extending across the head and foot areas of the sleep surface 40, respectively, and the second zone 72 extending across the central area of the sleep surface 40. Accordingly, the head, foot and central areas of the sleep surface 40 provide a softer and more independent feel while areas extending along either side of the central area (represented by the fourth and fifth zones 76, 78) provide a more firm, deck-like central support to the sleep surface 40.

In each of FIGS. 8-11, spring coils 20, 20' are arranged in rows 32A, 32B of like handedness, where the orientation of the spring coils 20, 20' in each individual row 32A, 32B is the same. As shown in each of FIGS. 8-11, the spring coils 20, 20' of a selected row 32A are oriented in one direction and the spring coils 20, 20' of the immediately adjacent row 32B are oriented in the opposite direction. The orientation of spring coils 20, 20' in each successive row along the length of the innerspring assembly 10 alternates such that each successive row has spring coils 20, 20' of alternating handedness. In this regard, adjacent rows 32 tend to counteract one another by the individual spring coils 20, 20' inclining and twisting in opposite directions.

In addition, it is possible to adopt a checkerboard arrangement for the spring coils 20, 20', 20" of the innerspring assembly 10. In this regard each individual spring coil 20, 20', 20" within the innerspring assembly 10 is of a hand opposite that of each adjacent spring coil 20, 20', 20" on each opposite side thereof within the same row and each adjacent spring coil 20, 20', 20" on each opposite side thereof within the same column 30. By this checkerboard arrangement of the spring coils 20, 20', 20" the spring coils 20, 20', 20" act in direct opposition to one another both lengthwise along the columns and widthwise across the rows 32. This checkerboard arrangement provides the innerspring assembly 10 with enhanced structural stability in each direction, as the individual spring coils 20, 20', 20" counteract their respective tendencies to incline or rotate when compressed.

Other possible arrangements are contemplated wherein the spring coils 20, 20', 20" are not arranged by orientation or handedness. It is also within the scope of the present invention that each of the spring coils 20, 20', 20" of a particular innerspring assembly 10 is each of the same handedness, as is depicted in FIGS. 3-6.

The overall size of the innerspring assembly 10 and the number of spring coils included 20, 20', 20" therein may vary in accordance with the size preferred for a particular end use. In each of FIGS. 3-6 and 8-12, the number of spring coils 20, 20', 20" depicted is representative. The actual number of spring coils 20, 20', 20" used in an innerspring assembly in accordance with the present invention may of course be more or less than that which is depicted in FIGS. 3-6 and 8-12.

Based on the foregoing information, it is readily understood by those persons skilled in the art that the present invention is susceptible of broad utility and application. Many embodiments and adaptations of the present invention other than those specifically described herein, as well as many variations, modifications, and equivalent arrangements, will be apparent from or reasonably suggested by the present invention and the foregoing descriptions thereof, without departing from the substance or scope of the present invention. Accordingly, while the present invention has been described herein in detail in relation to its preferred embodiments, it is to be understood that this disclosure is only illustrative and exemplary of the present invention and is made merely for the purpose of providing a full and enabling disclosure of the invention. The foregoing disclosure is not intended to be construed to limit the present invention or otherwise exclude any such other embodiments, adaptations, variations, modifications or equivalent arrangements; the present invention being limited only by the claims appended hereto and the equivalents thereof.

What is claimed is:

1. A one-sided innerspring assembly comprising:

a plurality of spring coils each comprising a length of spring wire formed at opposite upper and lower wire ends in respective upper and lower end turns and in an intervening coil extent therebetween, the spring coils being arranged side by side one another in parallel linear spring coil rows and parallel linear spring coil columns perpendicular to the spring coil rows, with the upper end turns of the spring coils essentially coplanar with each other and with the lower end turns essentially coplanar with each other, the lower end turn of each spring coil being closed by a knot formed between the lower wire end and the coil extent, the upper end turn of each spring coil of a first selected number of the spring coils being open with the upper wire end unknotted to the coil extent, the upper end turn of each spring coil of a second selected number of the spring coils being knotted with the upper end turn being closed by a knot formed between the upper wire end and the coil extent; and a plurality of connector wires integrating the upper end turns and lower end turns of the spring coils, respectively, for forming a stable lower base of the spring assembly.

2. A one-sided innerspring assembly in accordance with claim 1, wherein the spring coils being knotted at the upper end turn are arranged with respect to the spring coils being open at the upper end turn to form a plurality of zones with differing levels of relative firmness.

3. A one-sided innerspring assembly in accordance with claim 2, wherein a first zone comprised of spring coils being knotted at the upper end turn extends along the outer perimeter of the spring assembly and surrounds a second zone comprised of spring coils being open at the upper end turn.

4. A one-sided innerspring assembly in accordance with claim 2, wherein first and second zones each comprised of spring coils being open at the upper end turn extend along opposite sides of the spring assembly on either side of a third zone of spring coils being knotted at the upper end turn.

5. A one-sided innerspring assembly in accordance with claim 2, wherein first, second and third zones each comprised of spring coils being open at the upper end turn are arranged as spaced-apart rows with fourth and fifth zones each comprised of spring coils being knotted at the upper end turn interspersed between the first, second and third zones.

6. A one-sided innerspring assembly in accordance with claim 1, wherein, in at least a portion of spring coils having the upper end turn being open with the upper wire end unknotted to the coil extent, the portion of the length of spring wire forming the upper end turn includes at least one sinuous twist arranged therein.

7. A one-sided mattress comprising:

an innerspring assembly comprising:

a plurality of spring coils each comprising a length of spring wire formed at opposite upper and lower wire ends in respective upper and lower end turns and in an intervening coil extent therebetween, the spring coils being arranged side by side one another in parallel linear spring coil rows and parallel linear spring coil columns perpendicular to the spring coil rows, with the upper end turns of the spring coils essentially coplanar with each other and with the lower end turns essentially coplanar with each other, the lower end turn of each spring coil being closed by a knot formed between the lower wire end and the coil extent, the upper end turn of each spring coil of a first selected number of the spring coils being open with the upper wire end unknotted to the coil extent, the upper end turn of each spring coil of a second selected number of the spring coils being knotted with the upper end turn being closed by a knot formed between the upper wire end and the coil extent; and a plurality of connector wires integrating the upper end turns and lower end turns of the spring coils, respectively, for forming a stable lower base of the spring assembly.

8. A one-sided mattress in accordance with claim 7, wherein the spring coils being knotted at the upper end turn are arranged with respect to the spring coils being open at the upper end turn to form a plurality of zones with differing levels of relative firmness.

9. A one-sided mattress in accordance with claim 8, wherein a first zone comprised of spring coils being knotted at the upper end turn extends along the outer perimeter of the spring assembly and surrounds a second zone comprised of spring coils being open at the upper end turn.

10. A one-sided mattress in accordance with claim 8, wherein first and second zones each comprised of spring coils being open at the upper end turn extend along opposite sides of the spring assembly on either side of a third zone of spring coils being knotted at the upper end turn.

11. A one-sided mattress in accordance with claim 8, wherein first, second and third zones each comprised of spring coils being open at the upper end turn are arranged as spaced-apart rows with fourth and fifth zones each comprised of spring coils being knotted at the upper end turn interspersed between the first, second and third zones.

12. A one-sided mattress in accordance with claim 7, wherein, in at least a portion of spring coils having the upper end turn being open with the upper wire end unknotted to the coil extent, the portion of the length of spring wire forming the upper end turn includes at least one sinuous twist arranged therein.

* * * * *